United States Patent [19]

Golden

[11] 4,093,186

[45] June 6, 1978

[54] LINE BRAKE DEVICE USEFUL FOR FIRE ESCAPE

[76] Inventor: Steven T. Golden, 822 Teague, Santa Paula, Calif. 93060

[21] Appl. No.: 743,754

[22] Filed: Nov. 22, 1976

[51] Int. Cl.[2] ..... B65H 59/16

[52] U.S. Cl. ..... 254/156; 182/191; 188/65.1

[58] Field of Search ..... 188/65.1, 65.2, 65.4, 188/65.5, 166; 254/152, 188, 153, 154, 155, 156; 182/5, 6, 7, 191, 190, 193, 72; 24/115 F, 115 G, 122.6

[56] References Cited

U.S. PATENT DOCUMENTS

| | | | |
|---|---|---|---|
| 374,244 | 12/1887 | Fisher | 182/191 |
| 1,241,701 | 10/1917 | Bencur | 182/6 X |
| 3,437,178 | 4/1969 | Postlethwait | 182/5 X |
| 3,826,341 | 7/1974 | Ledner | 188/65.5 |

*Primary Examiner*—Trygve M. Blix
*Assistant Examiner*—Douglas C. Butler
*Attorney, Agent, or Firm*—Poms, Smith, Lande & Glenny

[57] ABSTRACT

A manually controlled device for lowering people or objects safely from tall buildings having two spaced pulley assemblies, held in place by a cylindrical frame. One end of the frame holding one pulley assembly is rotatable with respect to the other end of the frame. A rope threaded between the two pulley assemblies binds against itself when one pulley assembly is rotated with respect to the other pulley assembly. The rate of descent of a person or object connected to one end of a rope threaded through the device is controlled by the degree of rotation between the two pulley assemblies.

6 Claims, 6 Drawing Figures

10
18
26
28
30
36
38
40
42
44
46
48
50
52
54

LINE BRAKE DEVICE USEFUL FOR FIRE ESCAPE

BACKGROUND OF THE INVENTION

This invention relates o line brake mechanisms and more particularly to line braking devices for, but not limited to, use in lowering people or objects from buildings.

In buildings that lack an elaborate indoor or outdoor fire escape stairway, or in situations where the entrance to these escape routes may be blocked by fire or smoke, a manually controlled line brake-type fire escape device can be useful. These devices can normally be connected to any solid fixture inside or just outside the room from which escape is desired, and are controlled variously by a person remaining in the room, a person on the ground, or by the person escaping. It is desirable that these devices have a wide range of braking adjustments so that the speed of descent can be controlled smoothly.

There has been a long standing need for improved line brake controlled fire escapes. Prior to this invention the use of this type of device for descents from heights of over four stories was unsafe. The main problem with the prior devices is that the frictional force needed to slow the descent of the escapee is developed between the line and the device itself. Because of this friction and the small size of the devices, heat is generated faster than it can be dissipated, leading to a sharp rise in temperature. The portions of the device which are in contact with the line eventually become hot enough to destroy the line or fail.

Accordingly, it is a specific aim of this invention to introduce a manually operable line brake device capable of providing a wide continuous range of frictional force adjustments without the disastrous failure problem noted above.

SUMMARY OF THE INVENTION

In accordance with a broad aspect of the present invention at least one pulley together with guiding arrangements are used for extending a line over said pulley and guiding the line to and from said pulley along adjacent paths; and additional mechanical arrangements for rotating the guiding arrangements relative to the pulley to force adjacent sections of line into direct frictional contact with each other. The preferred embodiment of the present invention utilizes two pulley assemblies located opposite one another and rotatable with respect to one another.

The specific preferred embodiment is basically made up of two members, a cylindrical frame and a cylindrical head piece. One end of the cylindrical frame holds one of the two pulley asemblies. The head piece is rotatably connected to the other end of the frame and holds the other pulley assembly.

Aline, such as half-ton one-half inch nylon rope, is run between the frame pulleys and the head pulleys such that both ends emerge from the frame pulleys' end. Rotation of the head piece with respect to the frame places the sections of line inside the device in contact with each other. This contact provides the friction needed to brake the descent of a load connected to one of the lines emerging from the end of the frame when the device is connected to a support such as a tall building. The rate of descent can be adjusted by rotating the head piece with respect to the frame. Depending on the direction of rotation this either increases or decreases the amount of contact between the sections of line and thus increases or decreases the amount of frictional force being used to brake the fall.

A helical spring may be connected between the head piece and the frame as a fail safe mechanism. It is adjusted so that should manual control fail the head piece will be rotated with respect to the frame to a position of maximum braking force.

The line brake in accordance with the invention has the advantage that all of the heat of frictional braking is generated in, and is carried away by the rope passing through the device. Accordingly, prolonged usage without failure, and safe descent from relatively tall buildings, such as eight or ten or more stories high is possible.

Other objects, features and advantages of the invention will become apparent from a consideration of the following detailed description and from the drawings in which.

DETAILED DESCRIPTION

Figure 1:
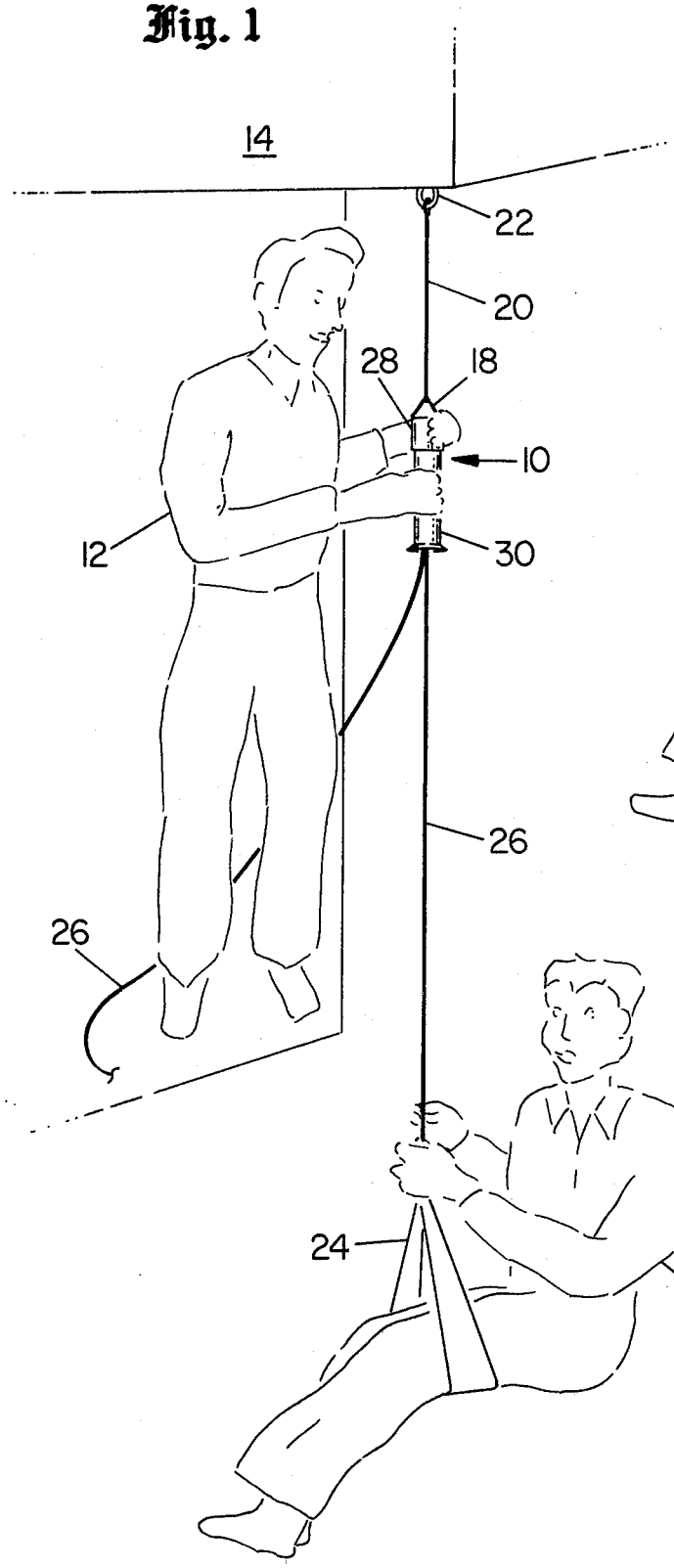
FIG. 1 shows the device in use in one mode, with one person controlling the descent of another.

Referring more particularly to the drawings it will be seen that FIG. 1 shows the device 10 in a possible use configuration. In this configuration person 12 remains in the building 14 controlling the descent of person 16. The device is secured to building 14 using handle 18, cable 20 and hook 22. Person 16 sits in harness 24, connected to line or rope 26, which is run through device 10 and into the room of building 14. Person 16's descent is controlled by the rotation of cylindrical head piece 28 with respect to cylindrical frame 30.

Figure 2:
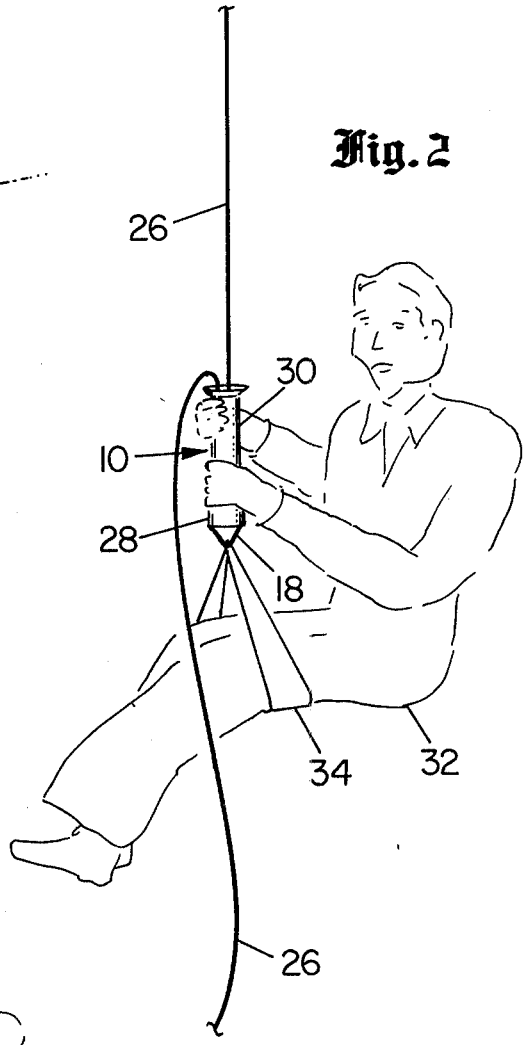
FIG. 2 shows the device in use in another mode, with the escaping person controlling his own descent.

FIG. 2 shows the device 10 in an alternate use configuration. Here person 32 is controlling his own descent with one hand on head piece 28 and the other on frame 30. The upper portion of rope 26 is connected to an overlying support (not shown) while the lower end reaches to the ground. Harness 34 supports person 32 and is connected to handle 18.

The structural design of the device will now be considered in further detail by reference o FIG. 3, FIG. 4, FIG. 5 and FIG. 6. It can be seen in FIG. 3 and FIG. 6 that handle 18 is secured to cylindrical head piece 28 by bolt 36 and nut 38. Bolt 36 also supports a pulley assembly including two pulleys 40 and 42 near the top of cylindrical head piece 28 as shown clearly in FIG. 4 and FIG. 6.

Figures 3, 4, 5, 6:
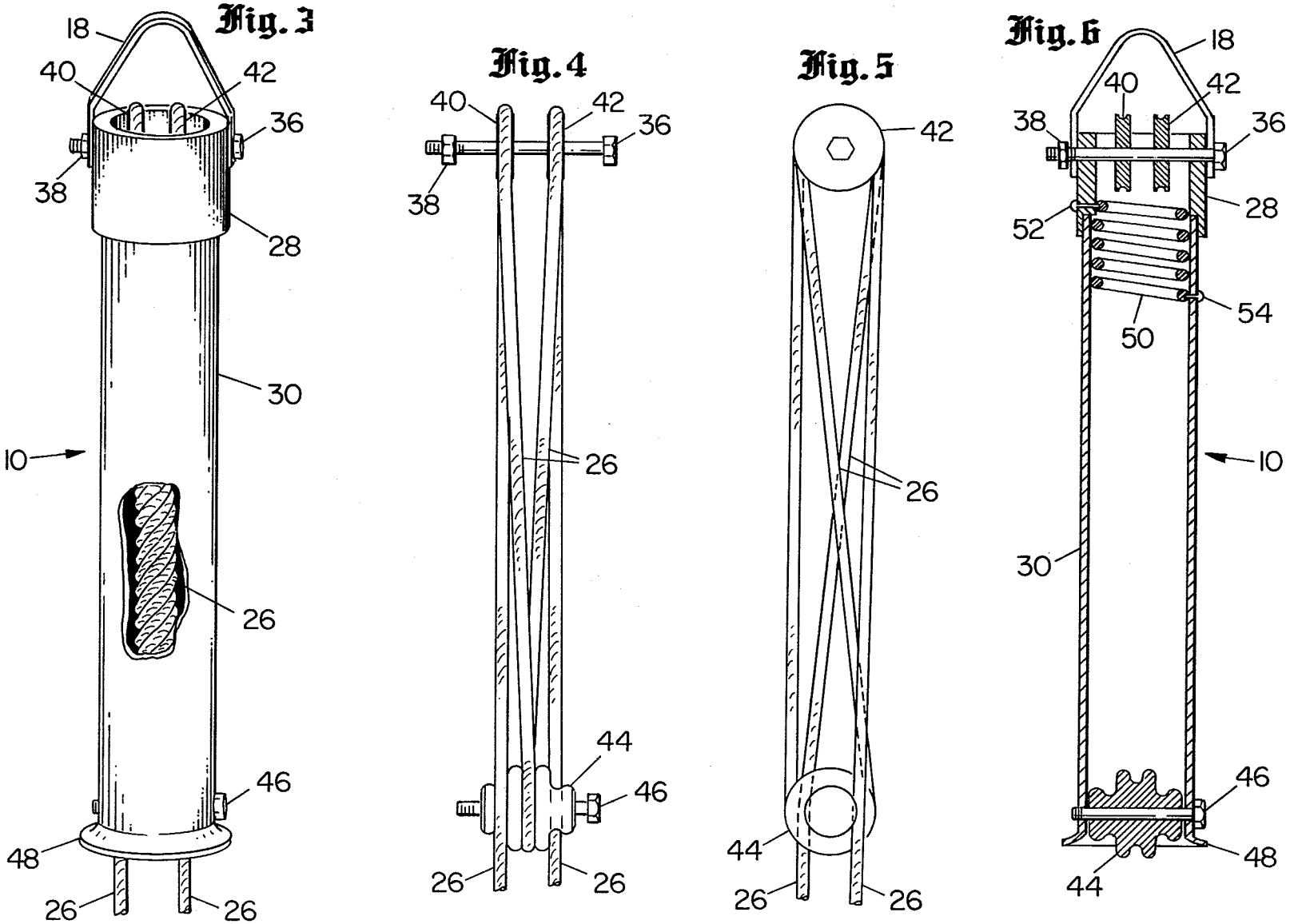
FIG. 3 is an isometric drawing of the device with a cutaway area for viewing the line.
FIG. 4 is a front view of the line configuration with respect to the pulleys, with the housing removed.
FIG. 5 is a side view of the line and pulley configuration.
FIG. 6 is a longitudinal cross-sectional view of the device.

Cylindrical head piece 28 is recessed to fit snugly but not bindingly over the top of cylindrical frame 30 so that it may be rotated with respect to frame 30. There is no need for any further connection between head piece 28 and frame 30 because, when loaded, rope 26 holds the two members together. Near the bottom of cylindrical frame 30 a pulley assembly including block pulley 44 is held in place, as shown in FIG. 6, by bolt 46. Shown in both FIG. 3 and FIG. 6 is flange 48 located at the bottom end of frame 30. Flange 48 helps to guide rope 26 when used in the configuration shown in FIG. 2.

The arrangement of rope 26 between the head piece 28 pulley assembly, including pulleys 40 and 42, and the block pulley 44 is shown in both FIG. 4 and FIG. 5. With rope 26 in this position, the device 10 will not act as a brake for any object connected to either of the emerging ends of line 26. Braking action is developed by twisting head piece 28 with respect to frame 30 which in turn forces the sections of rope 26 located between block pulley 44 and pulleys 40 and 42 in contact with one another. When in use with one-fourth inch half-ton nylon rope, this contact provides enough friction to safely control the descent of any escaping person. Heavier weights could be accommodated after appropriate increases in the size and strength of the device have been made.

In the cutaway part of FIG. 3, rope 26 is shown in a heavy braking configuration. Helical spring 50 (FIG. 6) can be used as a fail-safe mechanism, automatically orienting the device 10 in the absence of manual control to the heavy braking configuration shown in FIG. 3. One end of helical spring 50 is connected to head piece 28 using machine screw 52 and the other end of helical spring 50 is connected to frame 30 using machine screw 54. Before threading line 26 through the pulley 40 and 42 and pulley block 44 in the configuration shown in FIG. 4 and FIG. 5 the spring 50 is loaded by rotating head piece 28 with respect to frame 30. After the line is in position, the spring 50 is allowed t return to its most relaxed to which in this case would resemble the heavy braking configuration shown in FIG. 3. Descent is begun by turning head piece 28 in relation to frame 30 and thus backing off from the heavy braking position shown in FIG. 3 toward the zero braking position shown in FIG. 4 and FIG. 5. If for some reason during the descent manual control of the device is lost, helical spring 50 will return device 10 to the heavy braking position of FIG. 3 providing enough friction to halt the descent. If desired, an adjustable helical spring may be used in place of helical spring 50 and connected in a similar way to the outside of the device 10.

In accordance with an alternative embodiment, block pulley 44 could be replaced with just one pulley and two guides for emerging ends of line 26. In addition, the pulley assembly in the head piece 28 may have only one pulley while block pulley 44 is replaced with two guides for the emerging ends of line 26. Although in the preferred embodiment one-fourth inch, half-ton test nylon rope is used as the line 26, other line material, including metal strand cable could be employed.

In one of the embodiments of the device which proved satisfactory, the head piece 28 is 2 inches in diameter with one-fourth inch steel and the frame is 1 13/16 inches with one-eighth inch steel. The unit stands 11⅞ inches high with the head piece measuring 1¾ inches long and the frame 10½ inches long.

In summary, the present line braking device has permitted the safe use of this type of device for escape from buildings over four stories high. While other fire escape and line braking devices have been proposed (see U.S. Pat. Nos. 3,340,964, inventor Glover; 1,116,434, inventor Johansson; 409,511, inventor Slough; 303,426, inventor Frazier; 1,858,256, inventor Wolfe; 974,929, inventor Smith; 290,007, inventor Downing; 402,437, inventor Goldman; 197,727, inventor Gregoy), none of these have solved the problems solved by the presently disclosed arrangements. More specifically, the inventor not only recognized the problems but developed the unique solution using spaced, rotatable pulley assemblies.

What is claimed is:

1. A manually operated line braking mechanism comprising:

two pulley assemblies;

means for holding said pulley assemblies apart from each other, including a cylindrical frame holding one of said pulley assemblies and a cylindrical head piece holding the other of said pulley assemblies;

a line;

means for guiding said line through said pulley assemblies so that different sections of said line extend between said pulley assemblies with said line sections close to each other as said line runs through said pulley assemblies; and means for rotating one of said two pulley assemblies with respect to the other including a rotatable connection between said frame and head piece whereby the sections of line between said assemblies frictionally engage one another to provide braking action without significantly increasing the temperature of said braking mechanism.

2. A line braking mechanism as described in claim 1 wherein one of the said two pulley assemblies is made up of two adjacent freely turning pulleys and the other one of the said two assemblies is a freely turning block pulley with three grooves.

3. A line braking mechanism as described in claim 1 wherein said cylindrical head piece and said cylindrical frame are connected by means, including a helical spring, for automatically twisting said cylindrical head piece with respect to said cylindrical frame in the absence of manual control.

4. A manually operated line braking mechanism comprising:

two vertically spaced pulley assemblies;

upper and lower means for holding said pulley assemblies apart from each other;

a line;

means for guiding said line through said pulley assemblies so that different sections of said line extend between said pulley assemblies with said line sections close to each other as said line runs through said pulley assemblies; and means for rotating one of said holding means with respect to the other whereby the sections of line between said assemblies are twisted together in frictional engagement with one another to provide braking action without significantly increasing the temperature of said braking mechanism.

5. A line braking mechanism as described in claim 4 wherein aid means for holding said pulley assemblies include a cylindrical frame and a cylindrica head piece.

6. A line braking mechanism as described in claim 5 wherein said cylindrical head piece and said cylindrical frame are connected by means, including a helical spring, for automatically twisting said cylindrical head piece with respect to said cylindrical frame in the absence of manual control.

* * * * *